US012398887B2

(12) United States Patent
Dutilh

(10) Patent No.: US 12,398,887 B2
(45) Date of Patent: Aug. 26, 2025

(54) GAS ADAPTER FOR WOOD FIRE PIT

(71) Applicant: Guillaume Dutilh, Portland, OR (US)

(72) Inventor: Guillaume Dutilh, Portland, OR (US)

(73) Assignee: Guillaume Dutilh, Portland, OR (US)

( * ) Notice: Subject to any disclaimer, the term of this patent is extended or adjusted under 35 U.S.C. 154(b) by 0 days.

(21) Appl. No.: 18/515,045

(22) Filed: Nov. 20, 2023

(65) Prior Publication Data

US 2024/0167683 A1 May 23, 2024

Related U.S. Application Data

(60) Provisional application No. 63/384,571, filed on Nov. 21, 2022.

(51) Int. Cl.

| | |
|---|---|
| ***F24C 15/08*** | (2006.01) |
| ***F23D 14/04*** | (2006.01) |
| ***F24C 1/06*** | (2021.01) |
| ***F24C 3/08*** | (2006.01) |

(52) U.S. Cl.
CPC ..... *F24C 1/06* (2013.01); *F23D 14/045* (2013.01); *F24C 3/082* (2013.01)

(58) Field of Classification Search
CPC ..... F24C 1/06; F23C 3/082; F23D 14/045
USPC ..... 126/58, 512
See application file for complete search history.

(56) References Cited

U.S. PATENT DOCUMENTS

| | | | | | |
|---|---|---|---|---|---|
| 4,603,683 | A * | 8/1986 | Craver | F24B 7/025 | 126/190 |
| 5,647,340 | A * | 7/1997 | Shimek | F24C 3/004 | 126/85 B |
| 5,934,268 | A * | 8/1999 | Onocki | F24B 1/006 | 126/500 |
| 6,142,143 | A * | 11/2000 | Martin | F24B 1/1808 | 126/41 R |
| 6,237,588 | B1 * | 5/2001 | Hawkinson | F24B 1/1808 | 126/500 |
| 8,166,965 | B2 * | 5/2012 | Miles | F24B 1/1808 | 126/523 |
| 2006/0054160 | A1 * | 3/2006 | Borowske | F24B 3/00 | 126/512 |
| 2008/0081308 | A1 * | 4/2008 | Witzel | F23D 14/62 | 431/354 |
| 2009/0151711 | A1 * | 6/2009 | Wells | F24B 7/025 | 126/523 |
| 2010/0043775 | A1 * | 2/2010 | Phillips | F24C 3/006 | 126/500 |
| 2010/0288261 | A1 * | 11/2010 | Jones | F24C 1/02 | 126/25 R |
| 2011/0275022 | A1 * | 11/2011 | Griffith | F16L 19/025 | 285/133.11 |
| 2015/0168015 | A1 * | 6/2015 | Marple | F24H 9/1881 | 126/153 |
| 2017/0350600 | A1 * | 12/2017 | Jenkins | F24C 3/006 | |
| 2021/0199301 | A1 * | 7/2021 | Poggi | F24C 3/082 | |

* cited by examiner

*Primary Examiner* — Avinash A Savani

(57) ABSTRACT

According to an aspect of the present invention, there is provided a system for providing a gas burner adapter in a wood fire pit, comprising: a burner; a connector removably connected to a burner configured to transit through a narrow opening at the bottom of a wood fire pit; and a connection to a gas source.

14 Claims, 12 Drawing Sheets

GAS ADAPTER FOR WOOD FIRE PIT

CROSS-REFERENCE TO RELATED APPLICATIONS

The present application claims the benefit of U.S. Provisional Patent Application No. 63/384,571, filed Nov. 21, 2022, entitled GAS ADAPTER FOR WOOD FIRE PIT.

BACKGROUND

The present concept relates to a gas adapter that fits inside a wood fire pit, converting the wood fire pit to burn gas.

Prior art patent literature describes various convertible fire pits. For example, U.S. Pat. No. 9,038,620 discloses a multi-sided, portable outdoor fireplace convertible to an open grill, a rotisserie assembly, and a smoker assembly, the fireplace including a carriage assembly with a pair of rotatable wheels and at least one leg member; a base pan assembly for containing a solid fuel heat source affixed to the carriage assembly; and a removable screen assembly residing on top of the base pan assembly. When converted to an open grill, the fireplace further includes a grill bracket removably attachable to the screen assembly. When converted to a smoker, the fireplace, in one embodiment, further includes at least one heat/wind shield attachable to the screen assembly; a smoker adaptor body residing on the screen assembly; an adjustable grate support bracket affixed to the interior of the smoker body and a cover.

Nonetheless, prior art convertible fire pits do not provide a convenient means to alternate between wood as a fuel source and a gas fuel source such as propane or natural gas.

SUMMARY OF INVENTION

Therefore, the present invention provides a way to use gas for combustion instead of wood in a wood fire pit, which results in a safer fire that can be utilized where wood fire ban restrictions are in effect or in any other situation where gas is more convenient than wood.

According to an aspect of the present invention, there is provided a system for providing a gas burner adapter in a wood fire pit, comprising: a burner; an upper connector removably coupled to the burner, the upper connector configured to transit through a narrow opening at the bottom of a wood fire pit; and a lower connector removably coupled to the upper connector, which is coupled to a gas source.

DETAILED DESCRIPTION

Figure 1:
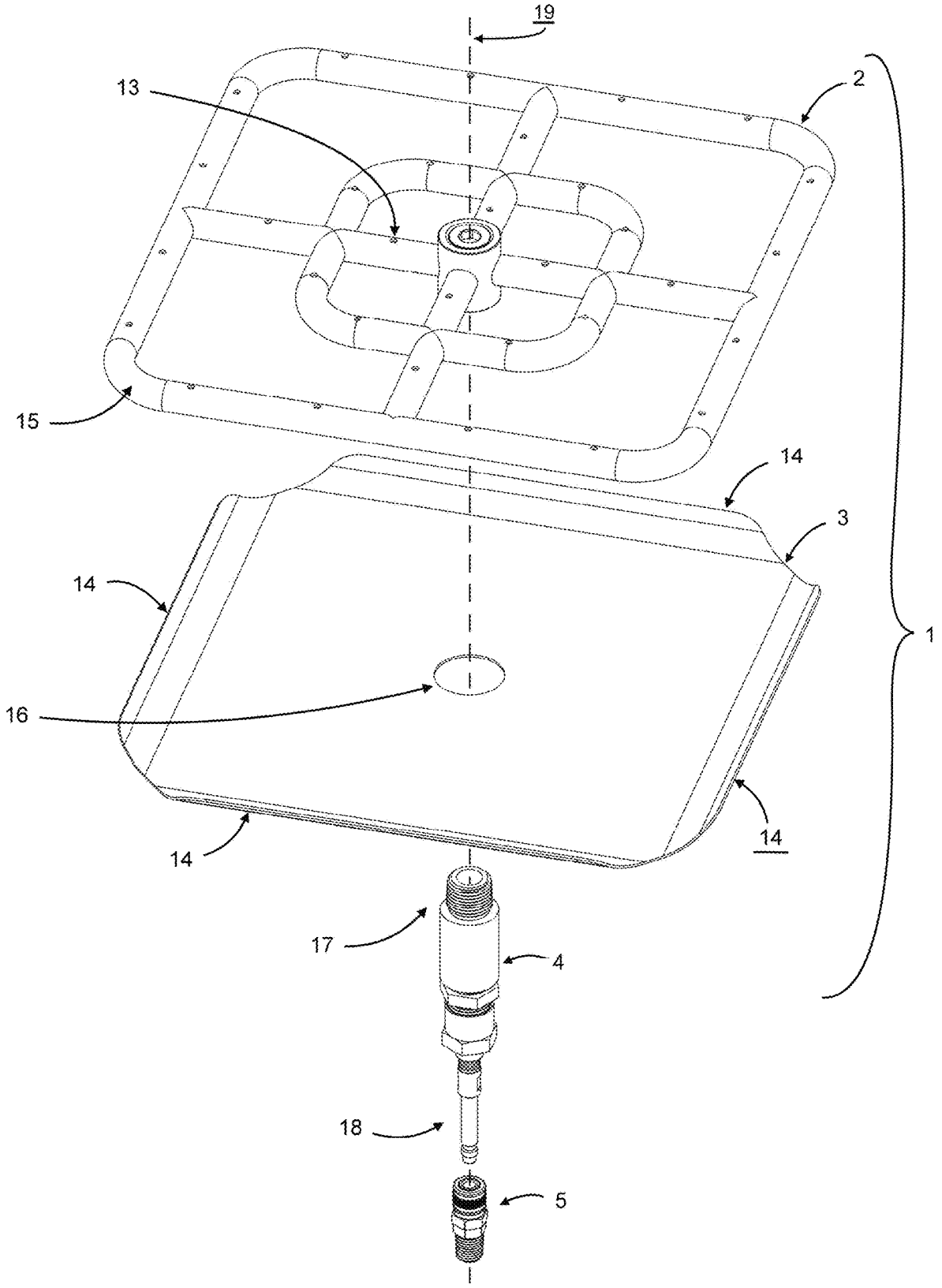
FIG. 1 is an exploded top perspective view of an embodiment of a gas adapter for wood fire pit according to the present disclosure.
Figure 2:
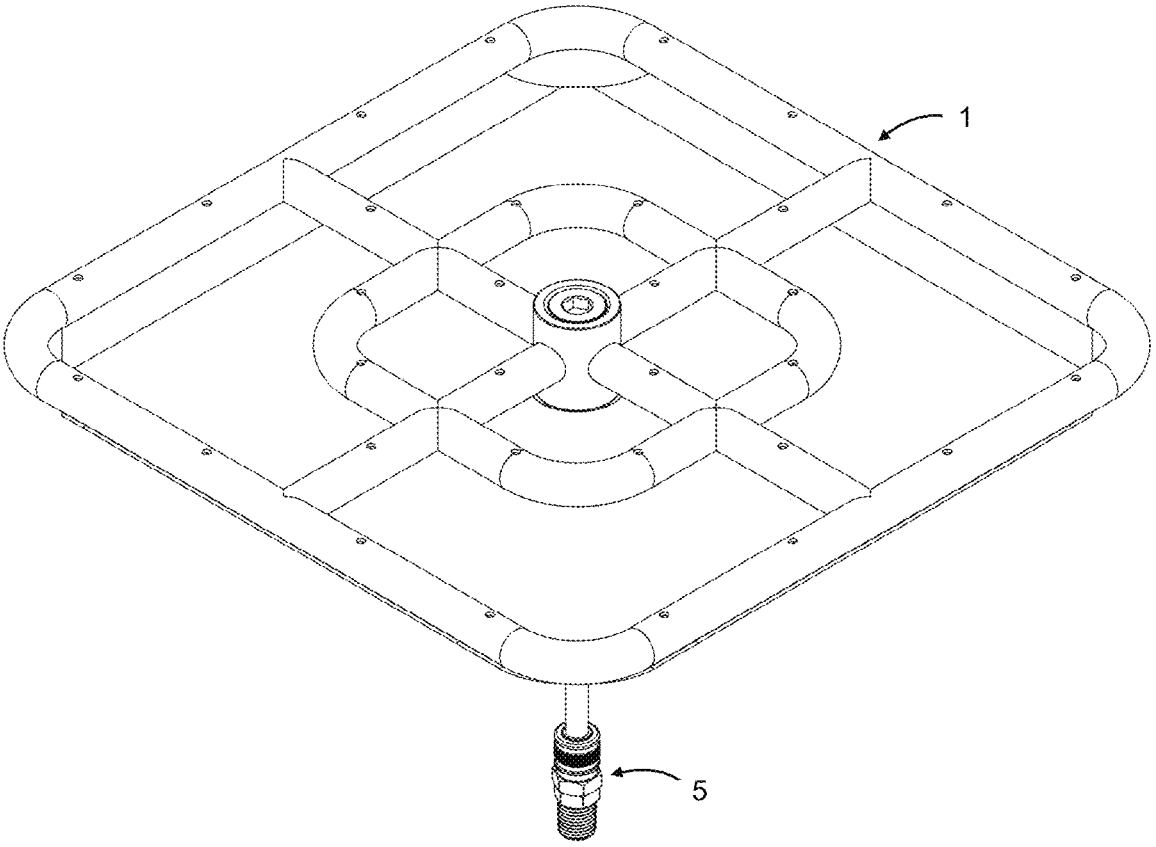
FIG. 2 is a top perspective view of the assembled adapter shown in FIG. 1 coupled to a lower connector.

A first embodiment of the present concept includes a burner, a plate, an upper connector, and a lower connector which may be coupled to a gas source. The burner and upper connector are assembled and fitted into a plate. These parts are then inserted into a wood fire pit. The burner and upper connector assembly is then coupled to a lower connector underneath the wood fire pit. The lower connector may then be coupled to a gas source.

In some embodiments, the wood fire pit has four walls, forming fire pit in the shape of an inverted four-walled pyramid. In the four-walled fire pit embodiment, the plate may be square shaped, and the plate may make contact with the four walls of the fire pit. Similarly, in the four-walled fire pit embodiment, the burner may be square shaped with rounded corners, and the burner may make contact with the square shaped plate.

Another embodiment of the present concept includes a lower connector which may be coupled to a hose, which is then connected to a gas source (with or without a regulator or valve).

Another embodiment of the present concept includes an air mixer, assembled within the upper connector, for better gas combustion.

Another embodiment of the present concept excludes a plate. In some embodiments, the plate is square shaped. In some embodiments, the plate has bent edges. In some embodiments, the burner only makes contact with the bent edges of the plate when the burner is assembled into the plate.

Another embodiment of the present concept includes a set of lava rocks to improve flame dispersion, heat retention, heat radiation and overall campfire appeal.

Another embodiment of the present concept includes a burner of different shape, such as circular, octagonal, rectangular, triangular, and so forth. In some embodiments, the burner forms a square shape having rounded corners.

The burner has one inlet for gas to enter and a plurality burner holes. The burner holes allow the gas flowing through the burner to exit the burner through the burner holes. In some embodiments, the burner may have 32 burner holes.

Another embodiment of the upper connector has a quick release fitting disposed on its lower end to couple with a quick release fitting (available in locking and non-locking options) on the lower connector.

The embodiment disclosed herein provides several advantages, the main advantage being to use gas for combustion instead of wood, which results in a safer fire that can be utilized where wood fire ban restrictions are in effect or any other situation where gas is more convenient than wood.

Additional advances include:

no smoke;

instantaneous on and off capability, along with fine control of flame size;

in the current embodiment, the adapter does not require any modification to a wood fire pit, which can still be used for burning wood (other wood fire pits could require the drilling of a hole large enough to fit the upper connector without compromising the wood burning capability of the wood fire pit);

the adapter can be disassembled, with or without tools, and pack flat;

the adapter cools quickly;

the adapter can be adapted to both propane and natural gases, with or without an air mixer or valve;

the adapter can be used with or without a plate, with or without lava rocks (or other gas fire enhancing accessories);

the adapter retains the ability to cook for fire pits that include such feature; and the adapter includes a locking quick release fitting to couple with the quick release fitting sleeve on the lower connector.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

In the embodiment of a gas adapter 1 depicted in FIG. 1, the upper connector 4 has two ends, a first end 17 and a second end 18. The upper connector first end is configured to couple with a burner. In this embodiment, the connection between the upper connector first end and the burner is a threaded connection.

Figure 3:
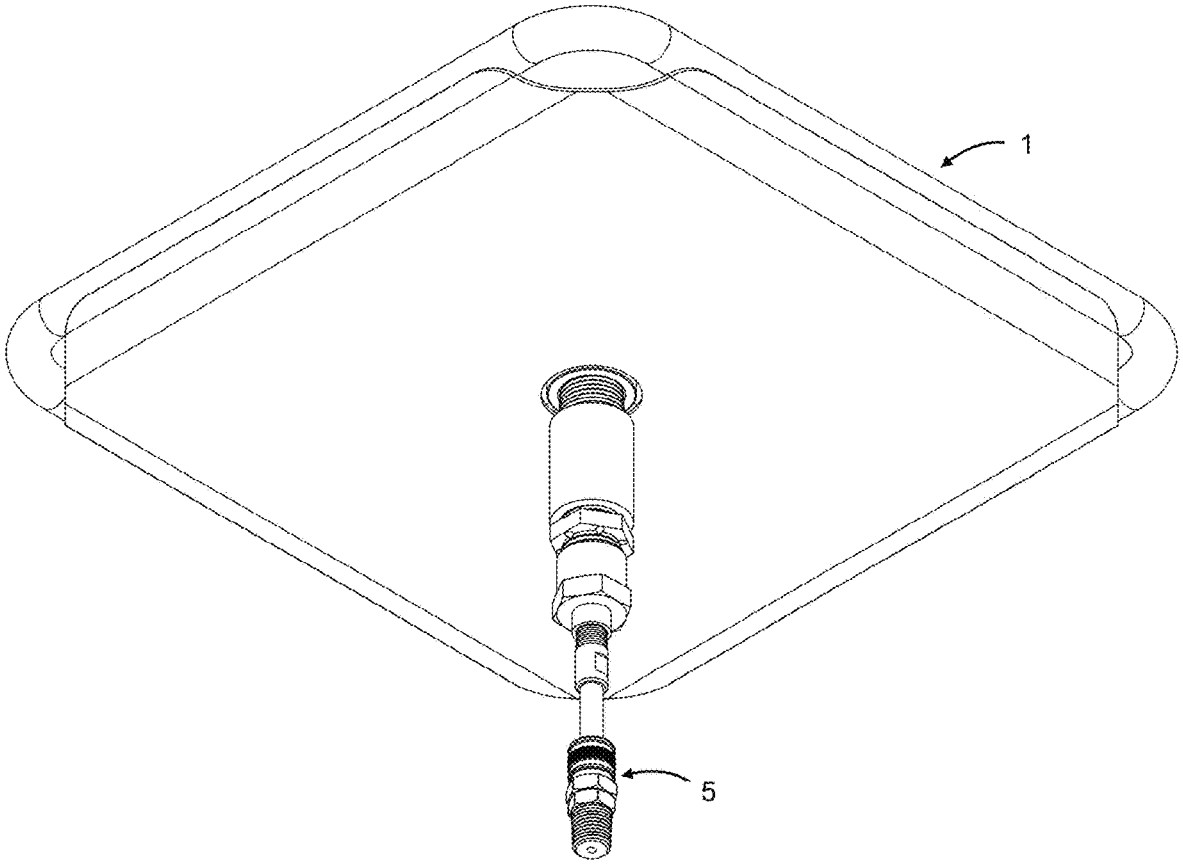
FIG. 3 is a bottom perspective view of the assembled adapter shown in FIG. 2.
Figure 10:
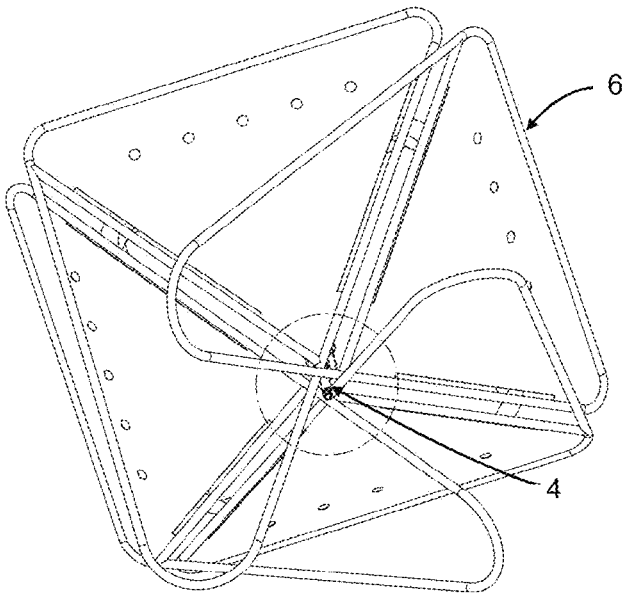
FIG. 10 is a bottom angled perspective view of the assembled adapter shown in FIG. 1, inserted into a wood fire pit.
Figure 11:
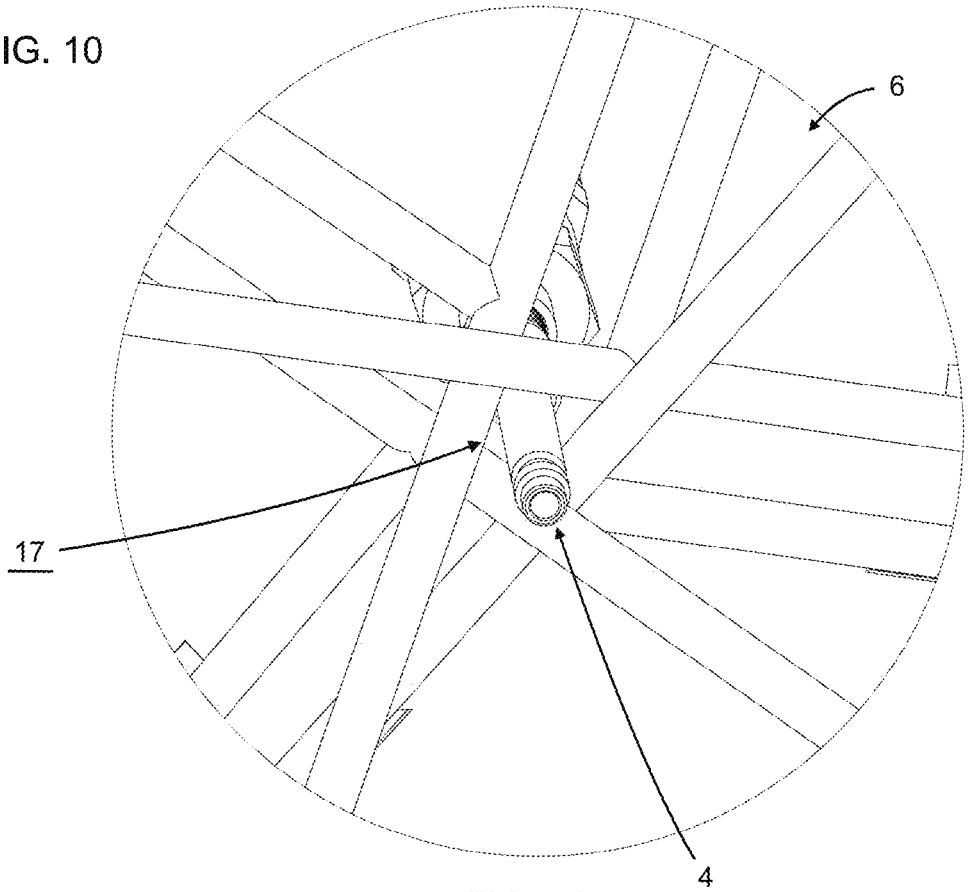
FIG. 11 is a detailed view of FIG. 10 highlighting the fitting at the end of the upper connector of the assembled adapter inserted through a wood fire pit.

As shown in FIG. 3 the burner 2 is threaded onto an upper connector 4, which is then inserted through an opening 16 in a plate 3. The plate 3 depicted in FIG. 1 and FIG. 5 has bent edges 14. When the burner 2 is assembled with the plate 3 the burner 2 contacts, and rests on top of, the plate 3. The assembly is then inserted into a wood fire pit 6, such as the one depicted in FIG. 6 and FIG. 7. The bent edges 14 of the plate 3 contact the fire pit 6 below. The second end of the upper connector 4 fits through a narrow opening 17 at the bottom of the wood fire pit 6 as seen in FIG. 10 and FIG. 11. The second end of the upper connector is configured to couple with the lower connector. In this embodiment the connection between the upper connector second end and the lower connector is a quick release fitting. After passing through the narrow opening 17 the upper connector 4 second end is then coupled to a lower connector 5 as depicted in FIG. 7. The lower connector 5 is itself connected to a gas source by any means necessary.

Figure 5:
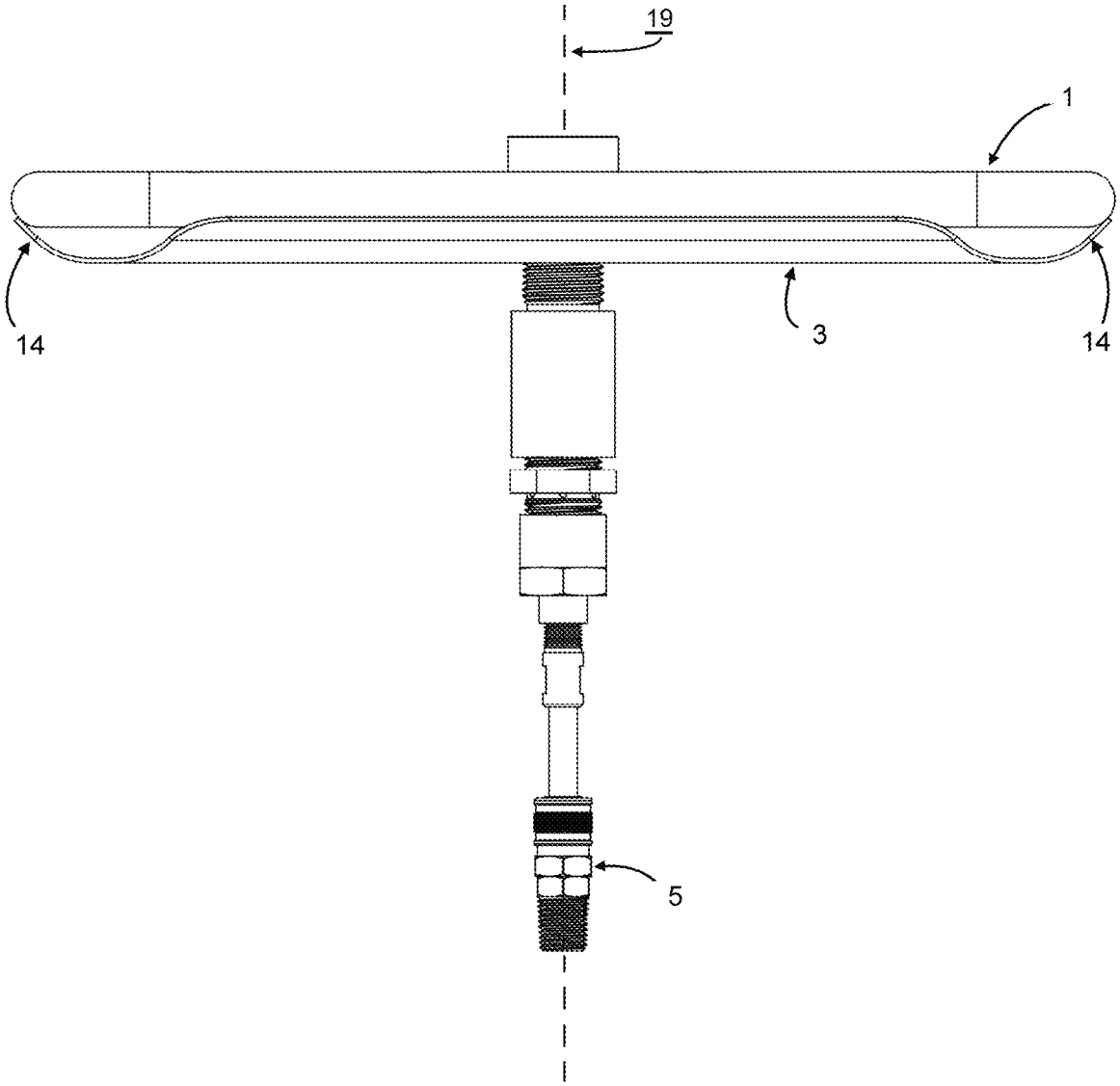
FIG. 5 is a side elevation view of the assembled adapter shown in FIG. 2.
Figure 12:
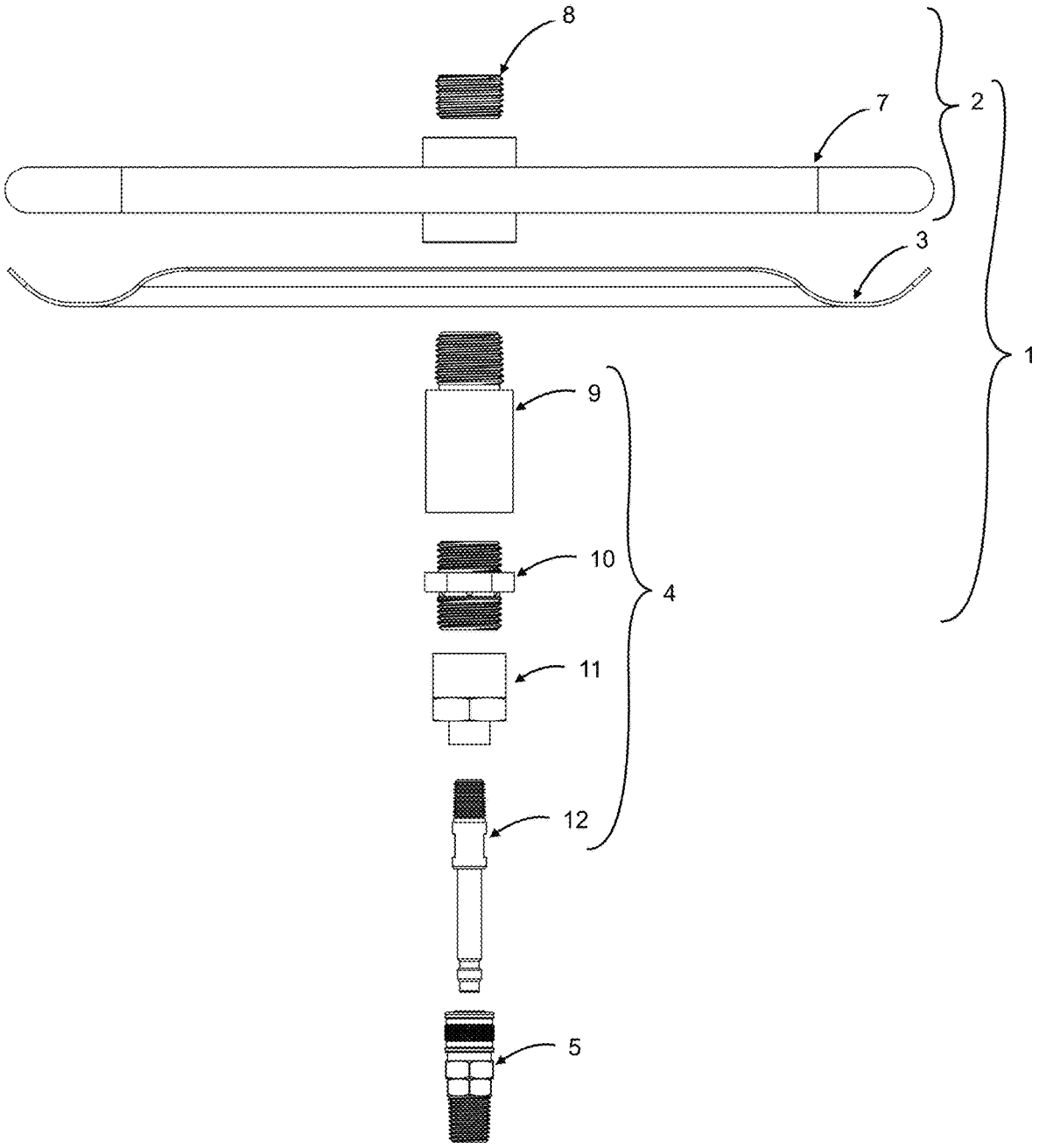
FIG. 12 is an exploded side elevation view of all the components of a version of the embodiment shown in FIG. 1.

As shown in FIG. 1. FIG. 5 and FIG. 12, the upper connector 4 and lower connector 5 are coaxially aligned when assembled together. In addition, the upper connector 4 and lower connector 5 may be coaxially aligned along a vertical axis 19 when assembled together, as depicted in FIG. 5.

Figure 6:
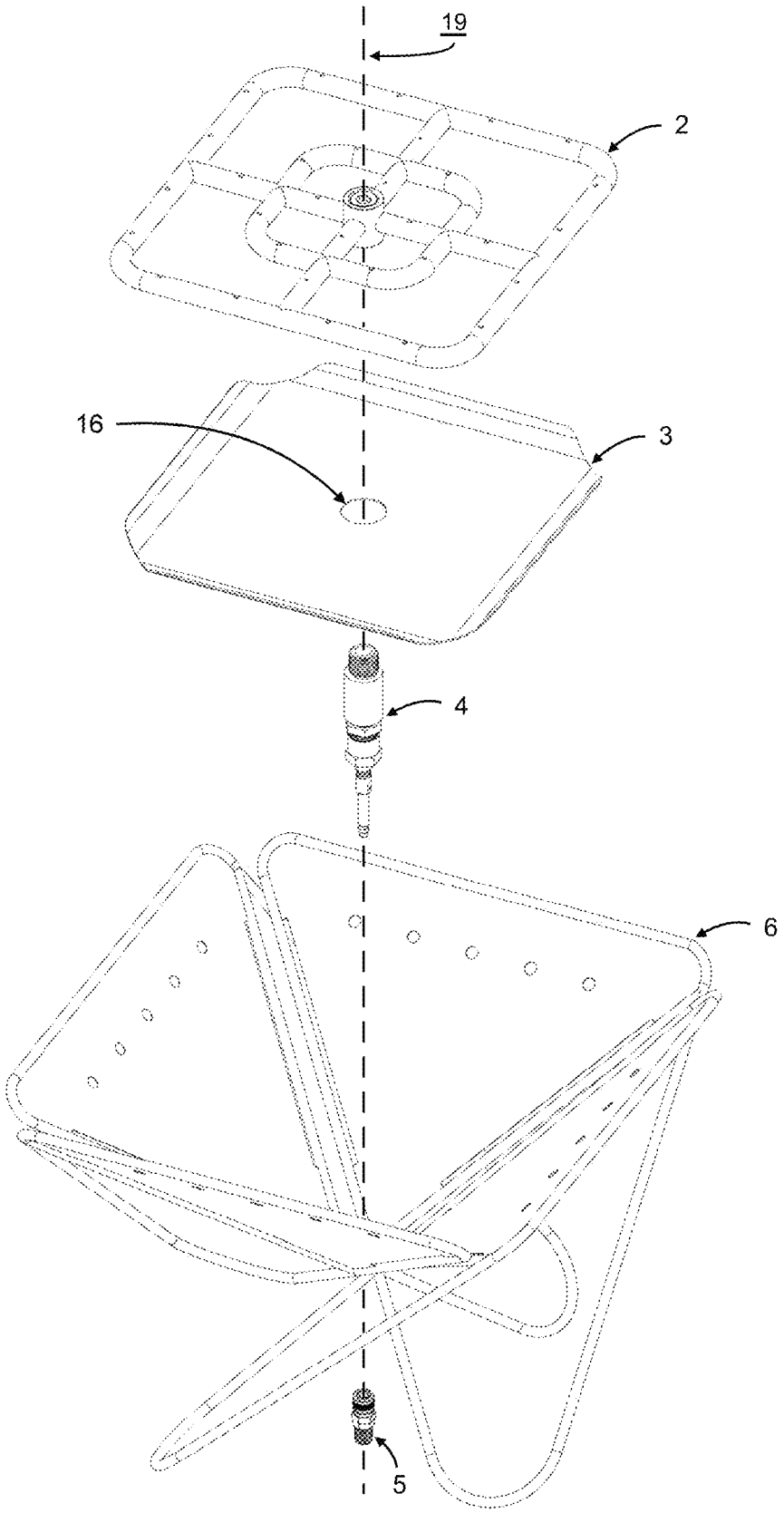
FIG. 6 is an exploded top perspective view of the adapter shown in FIG. 1 as it would line up with a wood fire pit.
Figure 7:
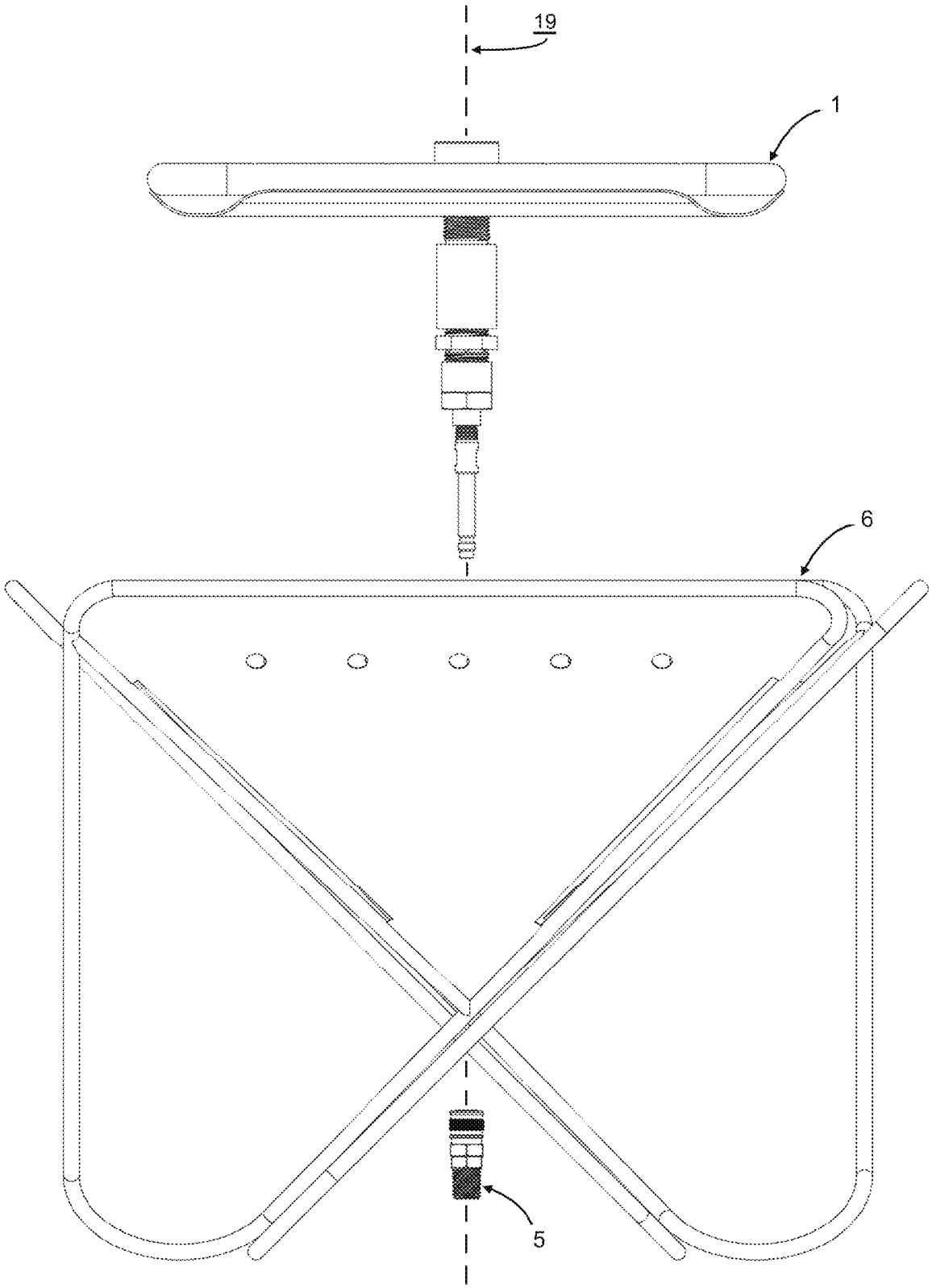
FIG. 7 is a side elevation view of the assembled adapter shown in FIG. 1 as it would be inserted into a wood fire pit and then coupled to a lower connector.
Figure 8:
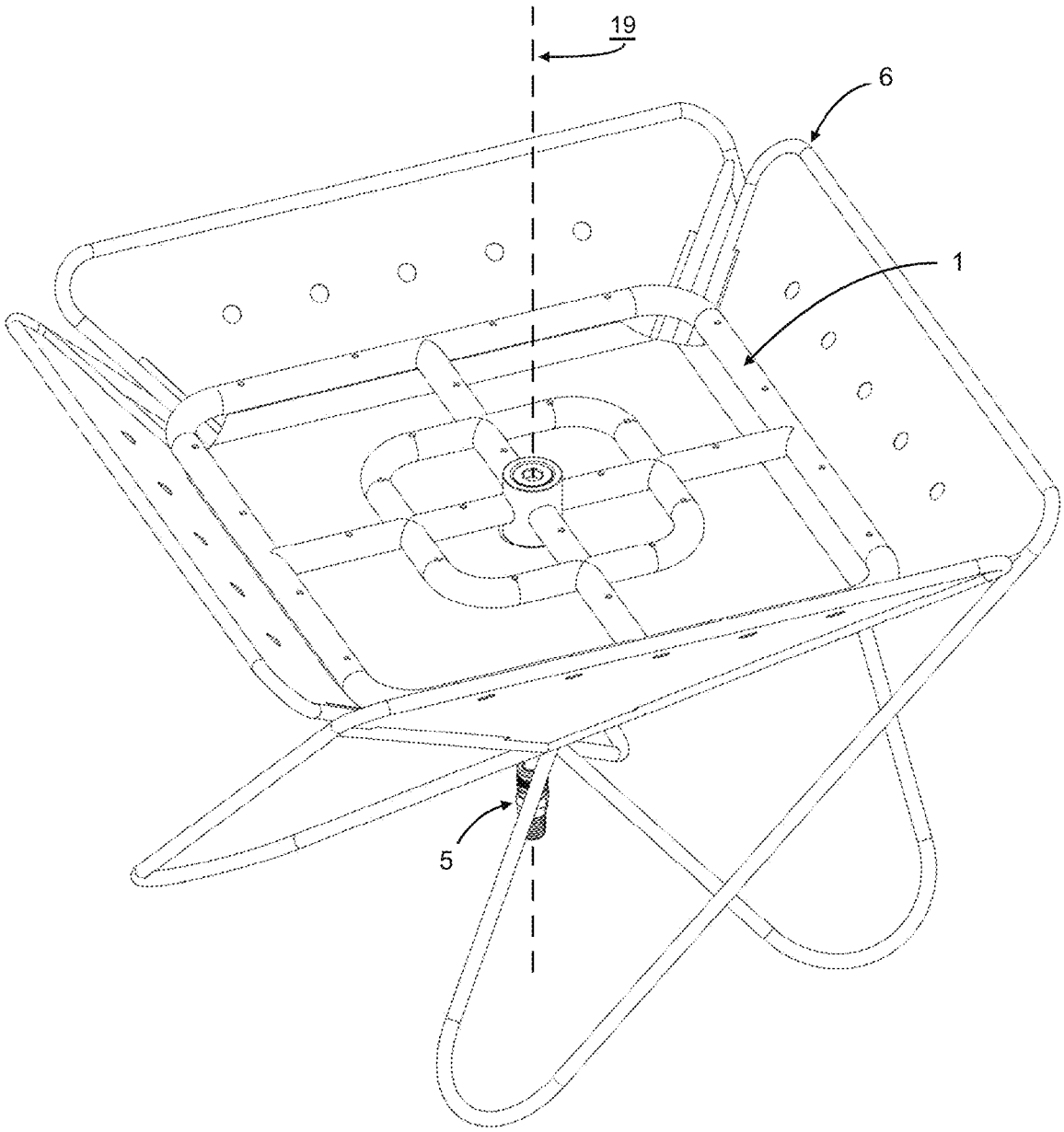
FIG. 8 is a top perspective view of the assembled adapter shown in FIG. 1 installed a wood fire pit and coupled to a lower connector.
Figure 9:
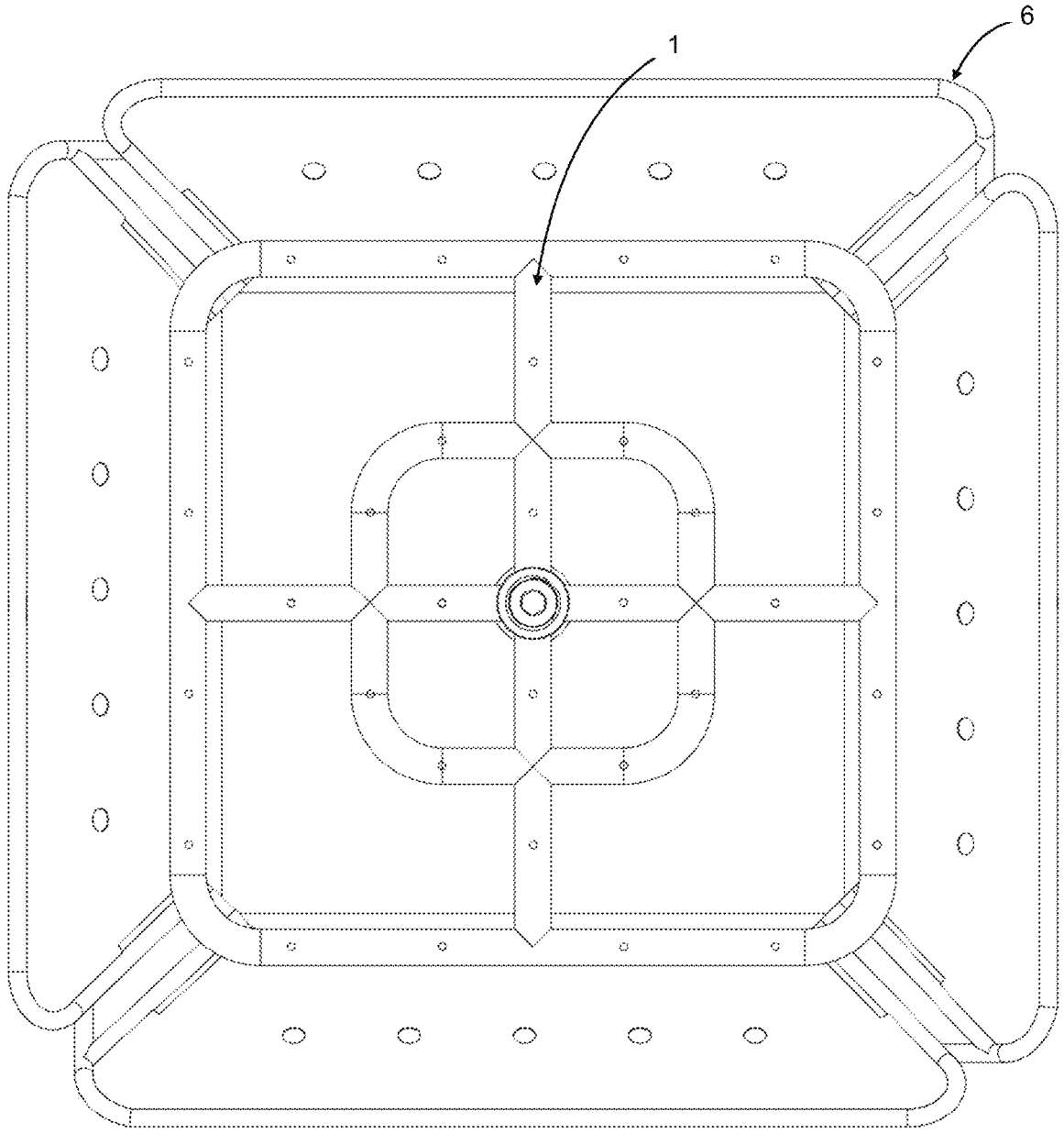
FIG. 9 is a top view of the assembled adapter shown in FIG. 1 installed in a wood fire pit.

As shown in FIG. 6. FIG. 7 and FIG. 8, the inlet of burner 1, upper connector 4, fire pit narrow opening 17 (detailed in FIG. 10 and FIG. 11) and lower connector 5 are coaxially aligned when assembled together. In addition, the inlet of burner 1, upper connector 4, fire pit narrow opening 17 (detailed in FIG. 10 and FIG. 11) and lower connector 5 may be coaxially aligned along a vertical axis 19 when assembled together, as depicted in FIG. 8.

Although shown as three parts that are assembled to form the adapter 1 in the embodiment depicted in FIG. 1, the functional elements of the adapter 1 may be constructed out of more or fewer assembled parts of different shapes, and maybe be integrally formed in a single piece, if desired. In the embodiment depicted, the adapter 1 comprising a burner 2, a plate 3 and an upper connector 4 is shown. A different embodiment could omit the plate 3 for use with natural gas or for use without gas fire enhancing accessories. Plate 3 can also be of a different shape and serve the same purpose. The burner 2 has a plurality of burner holes 13 which allow the gas to exit the burner. The burner 2 depicted in FIG. 1 has 32 burner holes 13. The burner 2 depicted in FIG. 1 through FIG. 9 is square shaped with rounded corners 15.

A different embodiment could use a quick release fitting coupling to couple the upper connector 4 to the burner 2 instead of a threaded connection.

Figure 4:
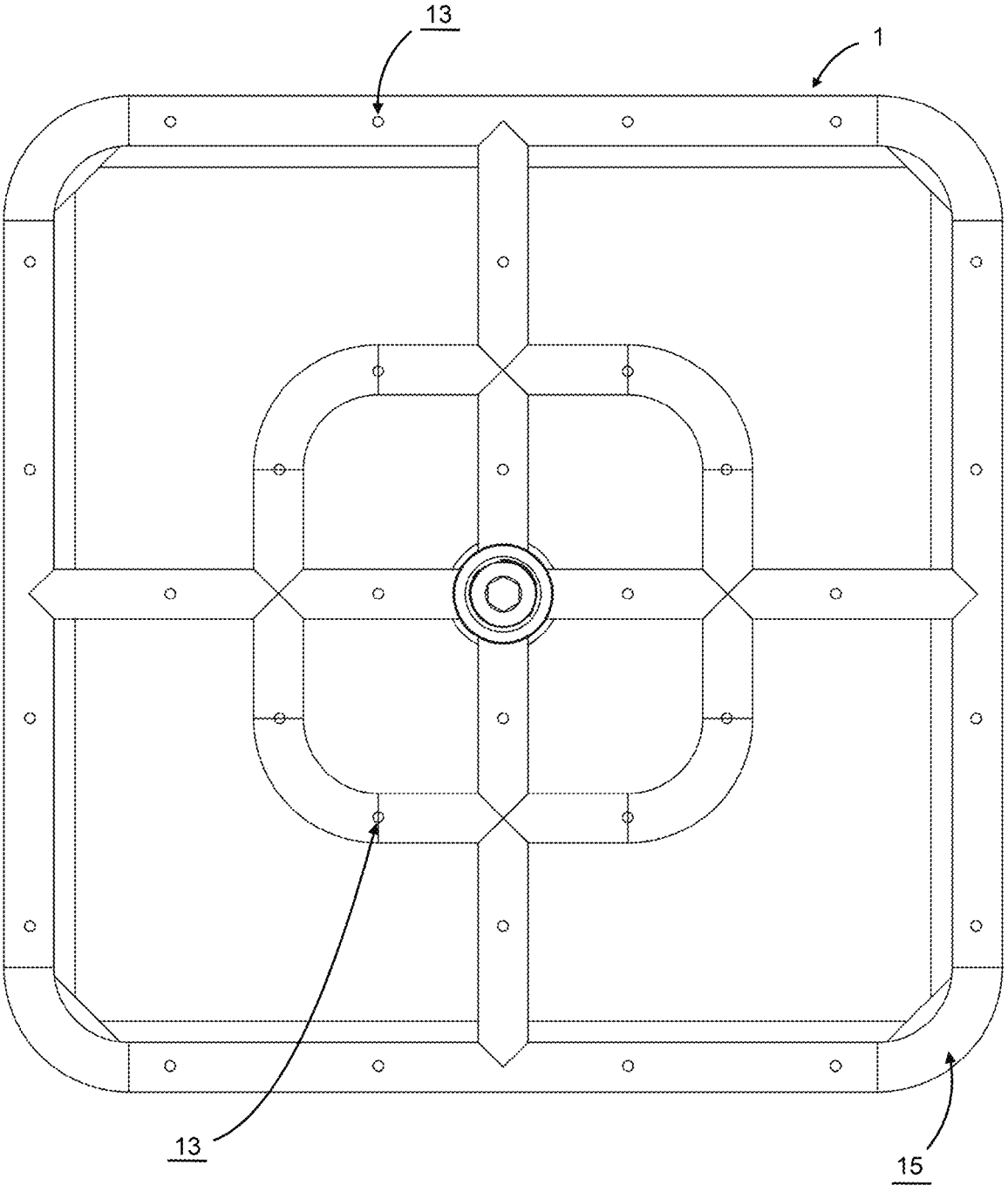
FIG. 4 is a top view of the adapter shown in FIG. 1.

FIGS. 2-5 illustrate one embodiment of the gas adapter 1 assembled and coupled to a lower connector 5 (in FIG. 4, the connection to a gas source 5 is not shown).

A different embodiment of the connection to a gas source 5 could be a threaded connection or a connection or any connection designed for use with gas.

FIG. 7 illustrates one embodiment of the gas adapter 1 assembled and lined up to be inserted into a wood fire pit 6, then coupled to a lower connector 5.

FIGS. 8-11 illustrate one embodiment of the gas adapter 1 assembled and installed into a wood fire pit 6, with a lower connector 5 coupled to the gas adapter. The lower connector is only visible in FIG. 8.

A different embodiment of the wood fire pit 6 could be any wood fire pit which has a hole at its bottom that can be utilized for the passage of gas.

A different embodiment of the wood fire pit 6 could be any wood fire pit that would require a modification to create an opening small enough for an upper connector 4 to fit without compromising the original ability of the fire pit to use wood.

FIG. 12 illustrates all the components of an embodiment of the gas adapter 1 along with a lower connector 5.

Although shown as two parts that are assembled to form a burner 2 in the embodiment depicted in FIG. 1, the functional elements of the burner 2 may be constructed out of more or fewer assembled parts of different shapes, and may be integrally formed in a single piece, if desired. In the embodiment depicted, the burner 2 is composed of a square burner 7 and a plug 8.

A different embodiment could use a round burner 2 or a burner of any shape. A different embodiment could combine the burner 2 and the plate 3 into one piece.

Although shown as four parts that are assembled to form the upper connector 4 in the embodiment depicted in FIG. 1, the functional elements of the upper connector 4 may be constructed out of more or fewer assembled parts, and may be integrally formed in a single piece, if desired. In the embodiment depicted, the upper connector 4 comprising a quick release fitting 12, a reducer fitting 11, an air mixer 10, and an extender fitting 9 is shown. This configuration is designed to enhance combustion of propane gases.

A different embodiment could omit the air mixer 10 both for propane combustion and natural gas combustion.

Figure 13:
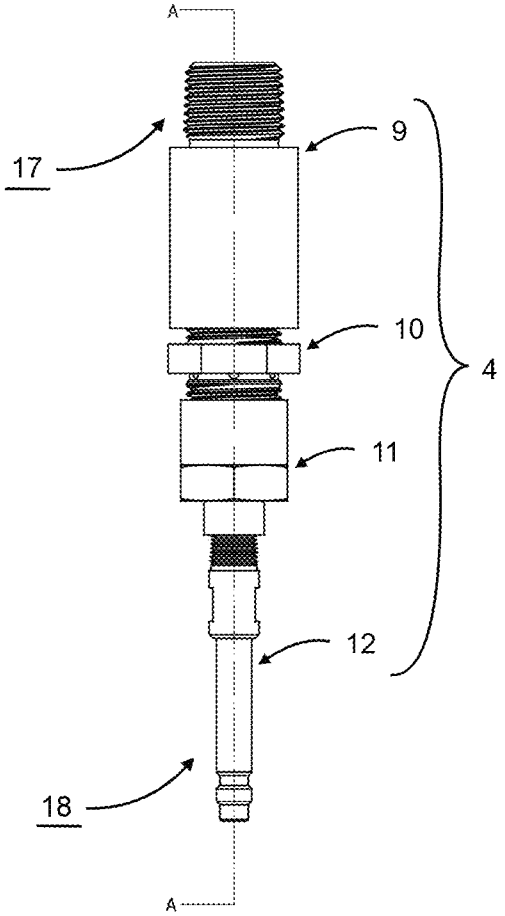
FIG. 13 is a side elevation view of the upper connector from the embodiment shown in FIG. 1 that connects a burner to a lower connector.
Figure 14:
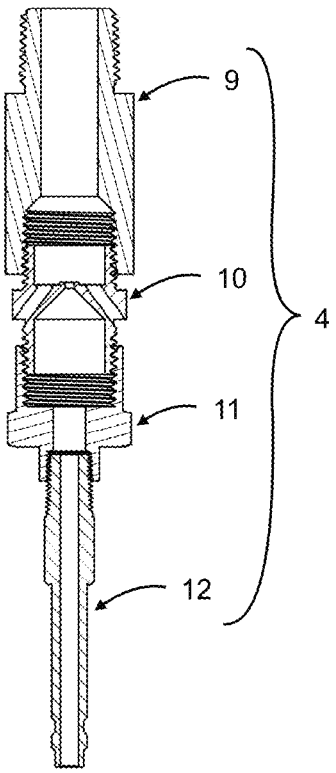
FIG. 14 is a cross-sectional view of the upper connector taken along line A-A shown in FIG. 13.

FIGS. 13 and 14 illustrate the details and cross-section of an embodiment of the upper connector 4. In FIG. 13 the center of the upper connector follows a straight line labeled A-A.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or upper connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A gas adapter system for an existing wood burning fire pit, said fire pit having at least three walls forming a pit structure with an open top configured to hold wood fuels, the gas adapter system comprising: a. a burner for use with gas configured to fit within said fire pit structure defined by the walls, said burner having a plurality of burner holes for gas to exit and one inlet for gas to enter, said burner replacing said wood fuels; b. a plate, said plate horizontally supporting said burner, said plate is square, said plate incorporating an opening, said opening allowing the passage of an upper connector for supplying fuel gas to said burner; i. wherein said upper connector has two ends; said first end is configured to be removably coupled to said burner inlet, said second end of the upper connector is configured to transit through a narrow opening in said fire pit, said upper connector second end is adapted with an upper connector quick release fitting said narrow opening being an existing gap in the structure of said fire pit, said upper connector being sufficiently long to allow said burner to rest horizontally on said plate, said upper connector second end protruding under said fire pit; c. a lower connector adapted with a quick release fitting configured to couple to said upper connector quick release fitting, the lower connector adapted to couple with a fuel gas source to convert said wood fire pit to burn fuel gas in lieu of wood fuels, said conversion being reversible to allow said wood fire pit to interchange between fuel gas or wood fuel.

2. A gas adapter system for an existing wood burning fire pit, said fire pit having at least three walls forming a pit structure with an open top configured to hold wood fuels, the gas adapter system comprising: a. a burner for use with gas configured to fit within said fire pit structure defined by the walls, said burner having a plurality of burner holes for gas to exit and one inlet for gas to enter, said burner replacing said wood fuels; b. a plate, said plate horizontally supporting said burner, said plate is square shaped with curved edges, said plate incorporating an opening, said opening allowing the passage of an upper connector for supplying fuel gas to said burner; i, wherein said upper connector has two ends; said first end is configured to be removably coupled to said burner inlet, said second end of the upper connector is configured to transit through a narrow opening in said fire pit, said narrow opening being an existing gap in the structure of said fire pit, said upper connector being sufficiently long to allow said burner to rest horizontally on said plate, said upper connector second end protruding under said fire pit, said upper connector second end is adapted with an upper connector quick release fitting; c. a lower connector adapted to couple to said second end of the upper connector, the lower connector adapted with a quick release fitting configured to couple to said upper connector quick release fitting, the lower connector adapted to couple with a fuel gas source to convert said wood fire pit to burn fuel gas in lieu of wood fuels, said conversion being reversible to allow said wood fire pit to interchange between fuel gas or wood fuel.

3. The gas adapter system of claim 2, wherein the burner makes contact with the plate when the burner is assembled with the plate.

4. The gas adapter system of claim 1, wherein the burner has 32 burner holes.

5. The gas adapter system of claim 1 wherein the fire pit has 4 walls, and the plate is square and makes contact with the walls of the fire pit, and the burner is square shaped with rounded corners and makes contact with the square shaped plate.

6. The gas adapter system of claim 1, wherein the upper connector comprises, a reducer fitting, an air mixer, and an extender fitting, the extender fitting adapted to couple with the burner, and the quick release extender fitting adapted to couple with the lower connector.

7. The gas adapter system of claim 1, wherein the quick release fitting on the lower connector is a locking quick release fitting.

8. The gas adapter system of claim 1, wherein the quick release fitting on the lower connector is not a locking quick release fitting.

9. A gas adapter system for an existing wood burning fire pit, said fire pit having at least three walls forming a pit structure with an open top configured to hold wood fuels, the gas adapter system comprising: a. a burner for use with gas configured to fit within said fire pit structure defined by the walls, said burner having a plurality of burner holes for gas to exit and one inlet for gas to enter, said burner replacing said wood fuels; b. a plate, said plate horizontally supporting said burner, said plate is square shaped, said plate incorporating an opening, said opening allowing the passage of an upper connector for supplying fuel gas to said burner; i, wherein said upper connector has two ends; said first end is configured to be removably coupled to said burner inlet, said second end of the upper connector is configured to transit through a narrow opening in said fire pit, said narrow opening being an existing gap in the structure of said fire pit, said upper connector being sufficiently long to allow said burner to rest horizontally on said plate, said upper connector second end protruding under said fire pit, said upper connector second end is adapted with an upper connector quick release fitting; c. a lower connector adapted to couple to said second end of the upper connector, the lower connector adapted with a quick release fitting configured to couple to said upper connector quick release fitting, said lower connector adapted to couple with a fuel gas source to convert said wood fire pit to burn fuel gas in lieu of wood fuels, said conversion being reversible to allow said wood fire pit to interchange between fuel gas or wood fuel, i. wherein when the gas adapter system is assembled the first end of the upper connector is coupled to the burner, the upper connector passes through the opening in the plate, the upper connector passes through the narrow opening in said fire pit, and the second end of the upper connector is coupled with the lower connector underneath the wood fire pit.

10. The gas adapter system of claim 1, wherein the gas type is natural gas.

11. The gas adapter system of claim 1, wherein the gas type is propane gas.

12. A method of assembling and inserting the system of claim 1 in an existing wood burning fire pit to add the ability for said fire pit to burn fuel gases while preserving the ability of said wood fire pit to revert to wood fuels, wherein the components of the system are a burner, a plate, an upper connector, and a lower connector, the method comprising: a. Coupling said upper connector to said burner, said burner having a plurality of burner holes for gas to exit and one inlet for gas to enter; b. Inserting said upper connector through an opening in said plate, said plate horizontally supporting said burner, said plate incorporating an opening, said plate is square shaped, said opening allowing the passage of an upper connector for supplying fuel gas to said burner; c. Inserting said upper connector through a gap in said fire pit until said plate contacts the walls of said fire pit, said burner contacting said plate, said connector protruding under said fire pit, wherein said upper connector has two ends; said first end is configured to be removably coupled to said burner inlet, said second end of the upper connector is configured to transit through a narrow opening in said fire pit, said upper connector second end is adapted with an upper connector quick release fitting, said narrow opening being an existing gap in the structure of said fire pit, said upper connector being sufficiently long to allow said burner to rest horizontally on said plate, said upper connector second end protruding under said fire pit; and d. coupling said upper connector to said lower connector, said lower connector adapted with a quick release fitting configured to couple to said upper connector quick release fitting, the lower connector adapted to couple with a fuel gas source to convert said wood fire pit to burn fuel gas in lieu of wood fuels, said conversion being reversible to allow said wood fire pit to interchange between fuel gas or wood fuel.

13. The gas adapter system of claim 1, wherein the upper connector and lower connector are coaxially aligned when assembled together.

14. The gas adapter system of claim 10, wherein the upper connector and lower connector are coaxially aligned with said burner inlet and said narrow opening in said fire pit along a vertical axis when assembled together.

* * * * *